US005404121A

United States Patent [19]

Cho

[11] Patent Number: 5,404,121

[45] Date of Patent: Apr. 4, 1995

[54] DEFLECTION YOKE WITH A TRIANGULAR MAGNETIC-FIELD LEAKAGE CANCELING COIL

[75] Inventor: Yoo Y. Cho, Suwon, Rep. of Korea

[73] Assignee: Samsung Electro-Mechanics Co., Ltd., Suwon, Rep. of Korea

[21] Appl. No.: 168,056

[22] Filed: Dec. 15, 1993

[30] Foreign Application Priority Data

Dec. 16, 1992 [KR] Rep. of Korea ..... PT.92-24433

[51] Int. Cl.[6] ..... H01H 1/00; H01J 29/06; H01J 1/52

[52] U.S. Cl. ..... 335/214; 315/8; 315/85; 361/150

[58] Field of Search ..... 335/210, 211, 212, 213, 335/214; 315/8, 85, 370; 361/150; 313/440, 431; 348/829, 830, 831

[56] References Cited

U.S. PATENT DOCUMENTS

| | | | |
|---|---|---|---|
| 4,788,470 | 11/1988 | Kohzuki | 313/440 |
| 4,853,588 | 8/1989 | Ohtsu | 313/440 |
| 4,914,350 | 4/1990 | Bosch | 315/8 |
| 4,922,167 | 5/1990 | Sluyterman | 313/431 |
| 5,170,094 | 12/1992 | Giannantonio | 313/431 |
| 5,189,348 | 12/1993 | Yokota | 315/399 |
| 5,317,239 | 5/1994 | Ohguro | 315/370 |

FOREIGN PATENT DOCUMENTS

| | | | |
|---|---|---|---|
| 4-233139 | 8/1992 | Japan | 313/440 |

OTHER PUBLICATIONS

Yokota, M et al. "S8-6 A New System Compensating Low . . . " Japan Display 92 Proceedings of the 12th International Display Conference Oct. 1992 pps. 285-288.

*Primary Examiner*—Leo P. Picard
*Assistant Examiner*—Stephen T. Ryan
*Attorney, Agent, or Firm*—Ladas & Parry

[57] ABSTRACT

A deflection yoke is mounted with a leaked magnetic-field canceling coil installed on a screen portion for attenuating externally emitted leakage magnetic field, using a horizontal deflection coil. The leaked magnetic-field canceling coil includes a bottom side in parallel with the surface of the screen portion of a coil separator contacting the horizontal deflection coil, left and right sides extending from both ends of the bottom side to an apex peak point to be set in the range of $\frac{1}{4}$ of the length of the bottom side from the alternative one end of the bottom side; and and a first and second diagonal sides straightly connecting one end of the left and right sides to the right and left ends of the bottom side, respectively. Another leaked magnetic-field canceling coil includes a bottom side formed in parallel with the surface of the screen portion of the coil separator contacting the horizontal deflection coil, left or right side extending straightly from alternative one end of the bottom side to an apex peak point to be set in the range of $\frac{1}{4}$ of the length of the bottom side from the alternative one end of the bottom side; and a diagonal side straightly connecting the side with the bottom side.

6 Claims, 5 Drawing Sheets

DEFLECTION YOKE WITH A TRIANGULAR MAGNETIC-FIELD LEAKAGE CANCELING COIL

BACKGROUND OF THE INVENTION

1. Field of the Invention

The present invention relates to a deflection yoke, and more particularly to a deflection yoke mounted with a leakage magnetic-field canceling coil on a screen portion thereof for effectively attenuating a leakage magnetic field produced around a cathode ray tube (CRT) as well as its front and rear portions, using a horizontal deflection coil mounted to horizontally deflect electron beams.

2. Description of the Prior Art

Generally, deflection yokes mounted on the CRTs of television receivers or monitors are largely classified into a saddle-toroidal type deflection yoke as shown in FIG. 1A and a saddle-saddle type deflection yoke as shown in FIG. 1B. Since a leakage magnetic field to be mentioned later is greater in the saddle-toroidal type deflection yoke that an in the saddle-saddle type deflection yoke, the saddle-toroidal deflection yoke will be taken to be described.

As shown in FIGS. 1A and 1B, a deflection yoke DY is constructed such that a pair of horizontal and vertical deflection coils HC and VC are mounted on the inner and outer sides of a pair of coil separators formed of a neck portion 2 and a screen portion 4.

A pair of ferrite cores 6 are provided on the inside of the wound vertical deflection coil VC as being wrapped by the vertical deflection coil VC in the saddle-toroidal type deflection yoke DY, and a pair of ferrite cores 6 are provided as wrapping the outer circumference of the vertical deflection coil VC in the saddle-saddle type deflection yoke DY. The respective pairs of ferrite cores 6 mounted in the two deflection yokes are fixed by a core clamp 8.

The deflection yoke DY is mounted in the neck portion of the CRT. When sawtooth pulses are applied to the horizontal and vertical deflection coils HC and VC, a magnetic field is generated in conformity with the Fleming's rule of left hand, so that red, green and blue electron beams emitted from an electron gun are deflected by the influence of a magnetic force, thereby forming a picture.

At this time, the magnetic field leakage outside of the CRT by current flowing through the horizontal and vertical deflection coils HC and VC of the deflection yokes DY is called as the leakage magnetic field. The horizontal and vertical deflection coils HC and VC in typical low-resolution monitors and small-sized televisions are supplied with current having a relatively low frequency, e.g., 15.75 MHz for the horizontal deflection coil and 60 Hz for the vertical deflection coil. Here, as shown in FIG. 2, leakage magnetic fields M1 and M2 are mainly generated from the horizontal deflection coil BC having the high frequency, but a frequency generated from the horizontal deflection coil HC is relatively low to result in negligible leakage magnetic field.

However, in case of the deflection yoke for high definition (HD) color monitors or large-sized televisions, current having a frequency, e.g., 35.75 MHz higher than that of the typical low-resolution monitors or small-sized televisions, is supplied to increase the leakage magnetic fields M1 and M2. The leakage magnetic field generated has a very low frequency magnetic field (VLMF) band of about 2 kHz–400 kHz, which may adversely affect a human body by causing various occupational diseases while working for a long time near the front of the color monitor, so that studies are actively carried out to attenuate the leakage magnetic field. Therefore, in order to inhibit excessive leakage magnetic current of the VLMF band beyond a predetermined quantity, a standard—an internationally adoptable security standard—stipulates below 25 nT per hour at a location spaced apart from the CRT by 5 m.

The conventional construction will be described with reference to FIGS. 3 to 6.

FIG. 3 is a front view showing one example of the deflection yoke mounted with the leakage magnetic-field canceling coil by a conventional technique. FIG. 4 is a view showing the generation of the magnetic field according to the deflection yoke shown in FIG. 3.

Referring to FIG. 3, a pair of leakage magnetic-field canceling coils 10 wound as a vertically-elongated rectangle are installed on both sides of the screen portion 4 to produce magnetic fields in the direction opposite to that of the leakage magnetic fields M1 and M2 which are formed toward the front and rear portions (Y axis) of the CRT screen caused by the horizontal deflection coil HC of the deflection yoke DY. At this time, the pair of leakage magnetic-field canceling coils 10 are vertical to the Y-axis of the deflection yoke, i.e., the front and rear portions of the screen.

The construction stated heretofore will be described in detail with reference to FIG. 4.

When the electron beams are deflected toward the right, the current applied to the horizontal deflection coil Hc generates the magnetic field M1 downwardly at the screen portion 4 of the coil separator, and the magnetic field M2 upwardly at the neck portion 2 of the coil separator. Meanwhile, an attenuation magnetic field from the leakage magnetic-field canceling coil 10 is generated in such a manner that a magnetic field M3 from the bottom side of the leakage magnetic-field canceling coil 10 is generated in the opposite direction to the leakage magnetic field M1 to counteract that from the screen portion 4 of the coil separator, but a magnetic field M4 from the upper side of the leakage magnetic-field canceling coil 10 generates in the same direction as the leakage magnetic field M2 to increase that M2 from the neck portion 2 of the coil separator.

In other words, this leakage magnetic-field canceling coil forms different magnetic fields at the upper coil and lower coil portions to allow the lower coil to decrease the leakage magnetic field on the screen portion of the coil separator, but the upper coil increases the leakage magnetic field on the neck portion of the coil separator to cause loss.

Moreover, in this manner, the number of turns of the leakage magnetic-field canceling coil must be increased to heighten the effect of attenuating the leakage magnetic field at the deflection yoke in the HD television monitor, large-sized television, or the like which is supplied with current having a high frequency to result int great leakage magnetic field.

If the number of turns of the leakage magnetic-field canceling coil is increased, inductance of a horizontal deflection circuit connected to the leakage magnetic-field canceling coil is increased to degrade sensitivity, i.e., the precise deflection of the electron beams in accordance with the current, of the deflection yoke.

Consequently, there is a limitation to increase the turns of the leakage magnetic-field canceling coil without affecting the product characteristics such as the sensitivity of the deflection yoke, so that the conventional deflection yoke has a problem of impeding effective elimination of the leakage magnetic field in the CRT.

In addition to this problem, the increased turns of the leakage magnetic-field canceling coil elongates overall length of the coil to produce a great amount of heat.

In order to solve the problems, a deflection yoke having a leakage magnetic-field canceling coil as shown in FIG. 5 has been presented in "National Technical Report (Vol. 38, No. 4)" published on 4 August, 1992.

FIG. 5A is a front view showing another example of the deflection yoke mounted with the leakage magnetic-field canceling coil according to a conventional technique, and FIG. 5B are a side view thereof. FIG. 6 shows distribution of the magnetic field from leakage magnetic-field canceling coil shown in FIG. 5, and FIGS. 7A and 7B show the magnetic field distribution of the deflection yoke mounted with the leakage magnetic-field canceling coil shown in FIG. 5.

Referring to FIG. 5, a leakage magnetic-field canceling coil 11 of a polygonal shape similar to a mountain peaked toward the electron gun with a bottom side in parallel with the screen portion 4 of the coil separator is mounted on the screen portion 4 of the coil separator formed in the deflection yoke DY.

After providing the deflection yoke mounted with the leakage magnetic-field canceling coil formed as above on the neck portion of the CRT, a constant frequency, e.g., a sawtooth pulse of 35.75 MHz and 60 Hz, is supplied to respective horizontal and vertical deflection coils. Then, a magnetic field is formed in conformity with the Fleming's rule of left hand. Therefore, the red, green and blue electron beams from the electron gun is subjected to a deflection force formed by the magnetic field to accurately scan respective pixels on the screen, thereby forming the picture.

As illustrated in FIGS. 6, 7A and 7B, among attenuation magnetic fields M5–M7 produced in the leakage magnetic-field canceling coil 11, the attenuation magnetic field M5 from the bottom side of the leakage magnetic-field canceling coil 11 shaped as the polygon similar to the peaked mountain has an excellent attenuation effect against the leakage magnetic field M1 around the front of the screen. As illustrated in FIG. 7A, the magnetic fields M6 and M7 from the upper side of the leakage magnetic-field canceling coil 11 are produced oblique to each other, enabling more effective attenuation of the leakage magnetic field M2 generated on the rear portion of the screen when compared with the leakage magnetic-field canceling coil 10 of the elongated rectangular shape shown in FIG. 3. As a result, the leakage magnetic-field canceling coil 11 having the shape similar to the peaked mountain has an advantage of more effectively attenuating the leakage magnetic field M1 than the leakage magnetic-field canceling coil 10 of the elongated rectangular shape mentioned in FIG. 3.

However, in spite of being slight, the magnetic field produced around the portion parallel with the bottom side when using the apex of the leakage magnetic-field canceling coil as a reference affect the leakage magnetic field from the rear portion of the screen. More specifically, since this magnetic field increases the leakage magnetic field on the rear portion as much as the total vector of the magnetic field generated on the upper side of the leakage magnetic-field canceling coil, the leakage magnetic field from the rear portion of the screen cannot be effectively attenuated as by the leakage magnetic-field canceling coil of the rectangular shape. Accordingly, the primary object of eliminating the leakage magnetic field cannot be fully achieved.

Also, The leakage magnetic-field canceling coil 11 having the shape similar to the peaked mountain has a relatively shortened coil as compared with that of the leakage magnetic-field canceling coil 10 having the rectangular shape shown in FIG. 3, thereby preventing the components from being overheated.

Furthermore, the leakage magnetic-field canceling coil as described above is shaped as the polygon to involve increased coil length, thereby causing a problem in preventing the heat generation when compared with that shaped as the simple triangle.

SUMMARY OF THE INVENTION

The present invention is devised to solve the above-described problems. Therefore, it is an object of the present invention to provide a deflection yoke having a leakage magnetic-field canceling coil capable of, even in products emitting a leakage magnetic field such as a HD color monitor or large-sized television, effectively eliminating magnetic fields on the front and rear portions of a CRT which is harmful to a human body neither increasing the number of turns of the leakage magnetic-field canceling coil nor degrading the product characteristics such as sensitivity of the deflection yoke.

It is another object of the present invention to provide a deflection yoke having a leakage magnetic-field canceling coil capable of maximally reducing heat produced from the leakage magnetic-field canceling coil by minimizing the length of the leakage magnetic-field canceling coil.

To achieve the above object of the present invention, there is provided a deflection yoke including a coil separator with a neck portion and a screen portion, and horizontal and vertical deflection coils provided on the inner and outer portions of the coil separator. The deflection yoke is further mounted with a leakage magnetic-field canceling coil which is formed of a bottom side formed in parallel with the screen portion of the coil separator, left and right sides extending straightly from both ends of the bottom side to an apex peak point to be set in the range of $\frac{1}{4}$ of the length of the bottom side from the both ends of the bottom side, a first diagonal side straightly connecting one end of the left side and the right end of the bottom side, and a second diagonal side straightly connecting one end of the right side and the left end of the bottom side.

To achieve another object of the present invention, a deflection yoke includes a coil separator with a neck portion and a screen portion, and horizontal and vertical deflection coils provided on the inner and outer portions of the coil separator. Furthermore, the deflection yoke is mounted with a leakage magnetic-field canceling coil which is formed of a bottom side formed in parallel with the surface of the screen portion of the coil separator contacting the horizontal deflection coil, left or right side extending straightly from alternative one end of the bottom side to an apex peak point to be set in the range of $\frac{1}{4}$ of the length of the bottom side from the alternative one end of the bottom side, and a diagonal side straightly connecting the side with said bottom side.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Referring to FIGS. 8, 9, 10A and 10B, in one embodiment of a deflection yoke mounted with a leakage magnetic-field canceling coil according to the present invention, a bottom side A is formed in parallel with a screen portion of a coil separator contacting a horizontal deflection coil HC, left and right sides B and B′ are provided by extending straightly from both ends of the bottom side to an apex peak point to be set in the range of $\frac{1}{4}$ from the both ends of the bottom side in the whole length of the bottom side. A first diagonal side C is formed to straightly connect one end of the left side B and the right end of the bottom side A, and a second diagonal side C′ is formed to straightly connect one end of the right side B′ and the left end of the bottom side A. A leakage magnetic-field canceling coil 12 is electrically connected in series with the horizontal deflection coil HC within the deflection yoke DY.

The above-state deflection yoke DY will be described in detail hereinafter.

The pair of the leakage magnetic-field canceling coils 12 are alternatively wound as symmetrically-arranged two triangles commonly holding one side (i.e., the bottom side A) of the deflection yoke DY. In other words, the triangle having the sides of A-B-C and another triangle having the sides of A-B′-C′ constitute the leakage magnetic-field canceling coils 12. The bottom side A parallels with the screen portion 4 of the coil separator installed in the deflection yoke DY, and the sides C and C′ respectively form angles of 30 and 150 from a line in parallel with the screen portion 4 of the coil separator. The left and right sides B and B′ are formed by extending straightly from both ends of the bottom side to an apex peak point to be set in the range of $\frac{1}{4}$ from the both ends of the bottom side towards a central axial in the whole length of said bottom side. Also, the diagonal sides C and C′ are formed by straightly connecting the apexes to the both ends of the bottom side A.

After installing the deflection yoke DY mounted with the leakage magnetic-field canceling coil 12 constructed as above, a sawtooth pulse having constant frequencies of 35.75 MHz and 60 Hz is applied to the horizontal and vertical deflection coils HC and VC, and then a magnetic field is produced in conformity with the Fleming's rule of left hand as mentioned above. Accordingly, the red, green and blue electron beams emitted from an electron gun is deflected under the influence of the deflection force caused by the magnetic field to accurately scan respective pixels on the screen, thereby forming a picture.

Figure 1A:
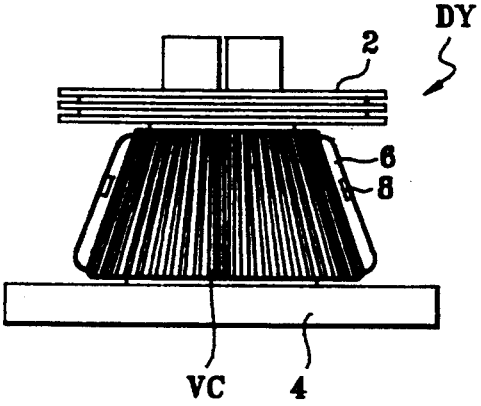
FIG. 1A PRIOR ART
FIG. 1A is a front view showing a general saddle-toroidal type deflection yoke.
Figure 1B:
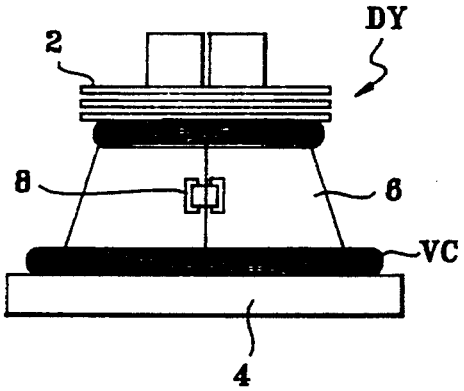
FIG. 1B PRIOR ART
FIG. 1B is a front view showing a general saddle-saddle type deflection yoke.
Figure 2:
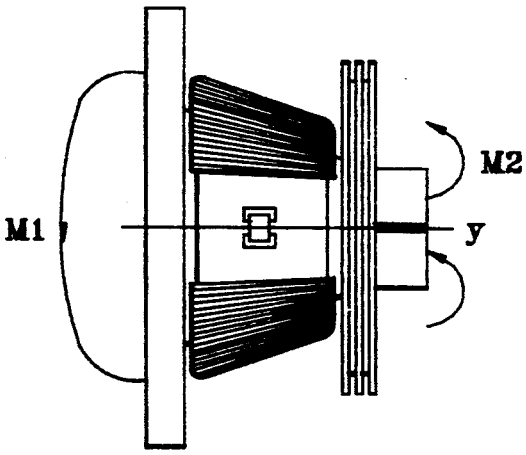
FIG. 2 PRIOR ART
FIG. 2 shows the generation of magnetic fields according to FIG. 1.
Figure 3:
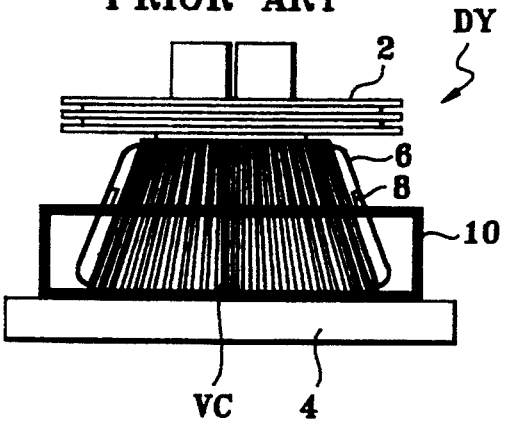
FIG.3 PRIOR ART
FIG. 3 is a front view showing one example of a deflection yoke mounted with a leakage magnetic-field canceling coil according to a conventional technique.
Figure 4:
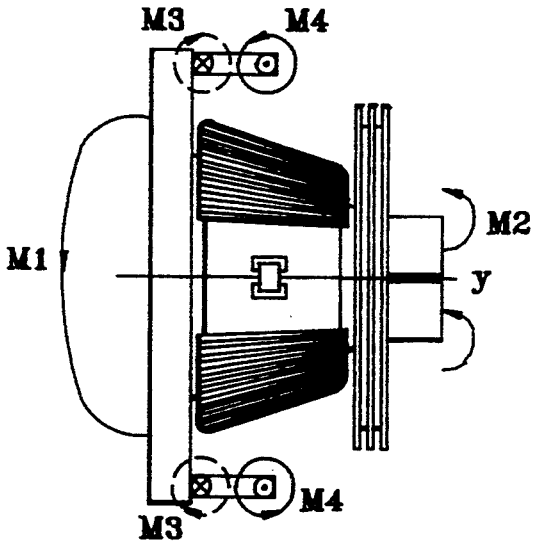
FIG.4 PRIOR ART
FIG. 4 shows the generation of magnetic fields according to FIG. 3.
Figure 5A:
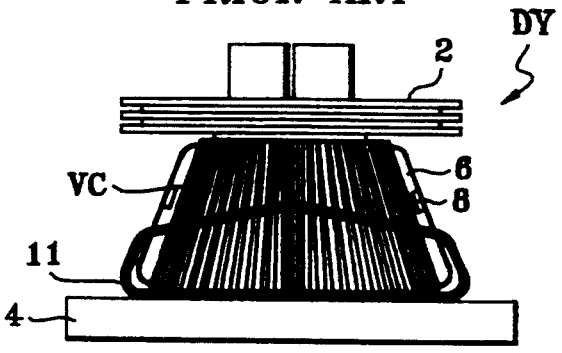
FIG.5A PRIOR ART
FIGS. 5A and 5B are a front view and a side view respectively showing another example of the deflection yoke mounted with the leakage magnetic-field canceling coil according to a conventional technique.
Figure 5B:
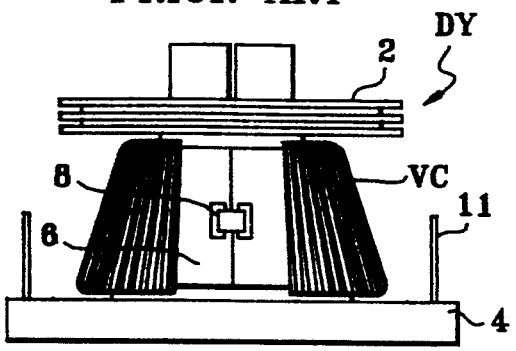
FIG.5B PRIOR ART
Figure 6:
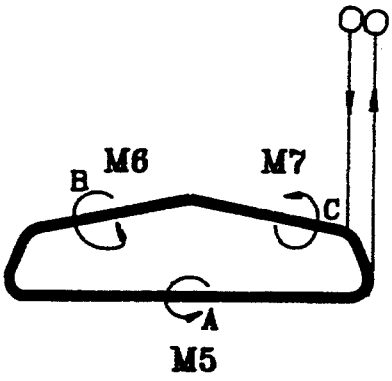
FIG. 6 PRIOR ART
FIG. 6 shows distribution of magnetic fields of the leakage magnetic-field canceling coil shown in FIG. 5.
Figure 7A:
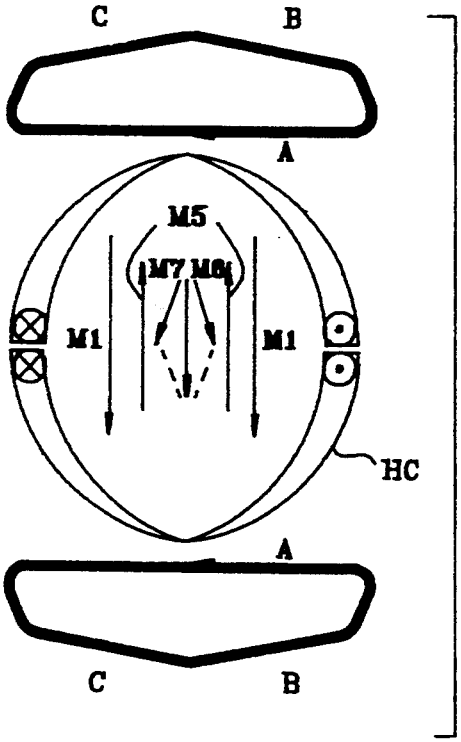
FIG. 7A PRIOR ART
FIGS. 7A and 7B show distribution of the magnetic fields from the deflection yoke mounted with the leakage magnetic-field canceling coil shown in FIG. 5.
Figure 7B:
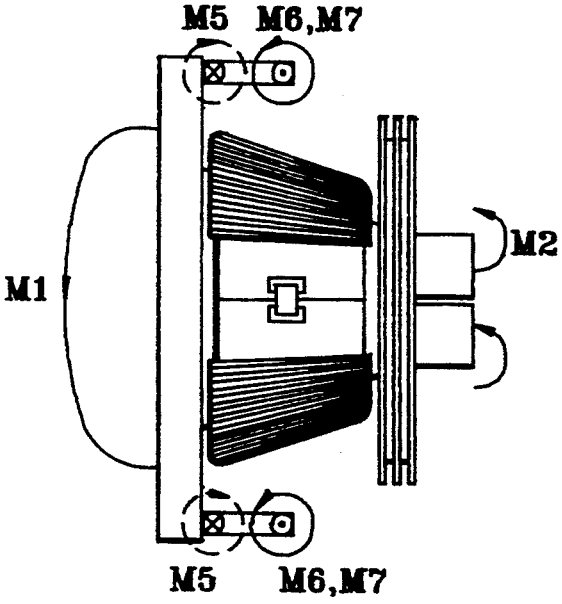
FIG. 7B PRIOR ART
Figure 8:
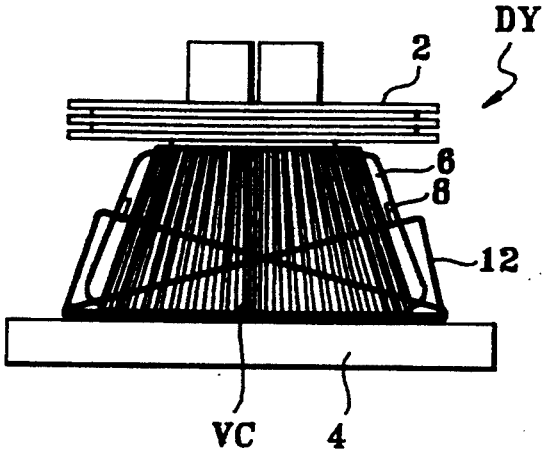
FIG. 8 is a front view showing one embodiment of a deflection yoke mounted with a leakage magnetic-field canceling coil according to the present invention.
Figure 9:
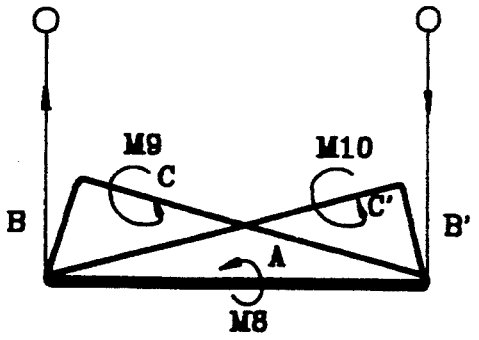
FIG. 9 shows distribution of magnetic fields from the leakage magnetic-field canceling coil shown in FIG. 8.
Figure 10A:
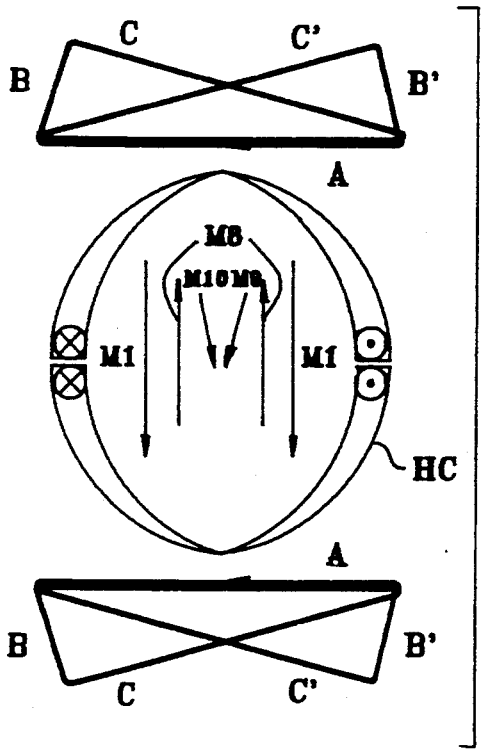
FIGS. 10A and 10B show distribution of the magnetic fields from the deflection yoke mounted with the leakage magnetic-field canceling coil shown in FIG. 8.
Figure 10B:
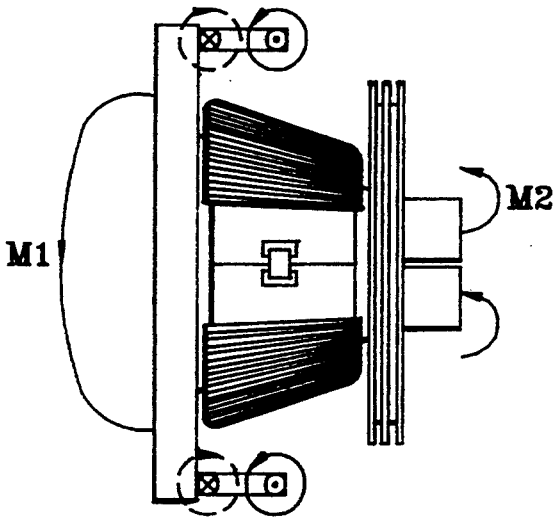

In the deflection yoke DY mounted with the leakage magnetic-field canceling coil 12, as shown in FIGS. 10A and 10B, almost all leakage magnetic field M1 generated around the front of the screen is attenuated by a magnetic field M8 from the bottom side A of the leakage magnetic-field canceling coil 12. Moreover, magnetic fields M9 and M10 produced on the first and second diagonal sides C and C′ of the leakage magnetic-field canceling coil 12 are oblique produced to counteract with each other, which do not affect a leakage magnetic field M2 around the rear portion of the screen. Thus, the effect of attenuating the leakage magentic field becomes very excellent as compared with the case of mounting the leakage magnetic-field canceling coil 11 having the shape similar to the peaked mountain as shown in FIGS. 5A and 5B.

By constituting the leakage magnetic-field canceling coil 12 with two triangles commonly sharing one side which are formed to have the shortest distance from respective apexes, the length of overall coil is reduced to be favorable with respect to the heat emission.

Figure 11:
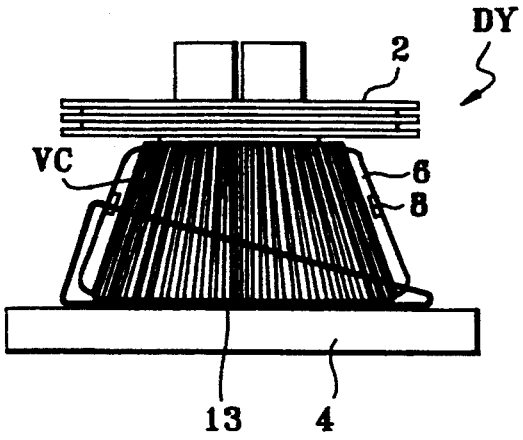
FIG. 11 is a front view showing another embodiment of the deflection yoke mounted with the leakage magnetic-field canceling coil according to the present invention.

Another embodiment of the deflection yoke mounted with the leakage magnetic-field canceling coil according to the present invention will be described with reference to FIG. 11.

Here, a pair of leakage magnetic-field canceling coils 13 are formed such that one side (i.e., the bottom side A) in parallel with the screen portion 4 of the coil separator is formed on both sides of the screen portion 4 of the coil separator, left or right side B is formed by extending straightly from alternative one end of said bottom side to an apex peak point to be set in the range of $\frac{1}{4}$ of the whole length of the bottom side from the alternative one end of said bottom side; and a diagonal side C is formed by straightly connecting said side B with said bottom side A.

The deflection yoke having the above-described construction cannot effectively eliminate the leakage magnetic field produced around the side of the monitor as compared with the leakage magnetic-field canceling coil 11 having the shape similar to the peaked mountain as shown in FIGS. 5A and 5B. However, the influence of the leakage magnetic field generated around the side of the screen is negligible in general televisions. Therefore, in the general televisions, the leakage magnetic-field canceling coil 13 having the triangular shape decreases overall coil length than that for the leakage magnetic-field canceling coil 11 having the shape similar to the peaked mountain, thereby effectively decreasing the heat emission.

If the total lengths of the sides B and C exceeds twice the length of the bottom side A owing to influence of the inductance of the coil, the size of the magnetic field produced from the bottom side A is relatively decreased to degrade its effect. Consequently, the sum of the lengths of the sides B and C should have a range from 1.02 to 2 times the length of the bottom side A.

On the other hand, the present invention can be applied to the saddle-saddle type deflection yoke in the same manner.

In more detail, since the amount of the leakage magnetic field produced from the saddle-saddle type deflection yoke is smaller than that from the saddle-toroidal type deflection yoke, the above-described method can be utilized for the saddle-saddle type deflection yoke, thereby more effectively decreasing the leakage magnetic field than by tile saddle-toroidal type deflection yoke.

As described above, the present invention relates to a leakage magnetic-field canceling coil installed on the screen portion of a deflection yoke for attenuating the leakage magnetic field emitted out of the screen, using the horizontal deflection coil. This leakage magnetic-field canceling coil is provided to have symmetrically shaped two triangles in which the bottom side parallels with the screen portion, and other sides commonly hold the bottom side not to be in parallel with the bottom side while forming angles of about 10 from the bottom side.

As a result, the length of the leakage magnetic-field canceling coil can be reduced thanks to the geometrical shape thereof to decrease inductance value of the horizontal deflection circuit, so that the leakage magnetic-field canceling coil is wound much more than that having the rectangular or peaked mountain shape with the same inductance value, thereby increasing the effect of attenuating leakage magnetic field.

By shortening the length of the leakage magnetic-field canceling coil to obtain the same effect of attenuating the leakage magnetic field, the manufacturing cost is economized and problems of lowered sensitivity and heat emission in the deflection yoke caused by the increased leakage magnetic-field canceling coil can be solved.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. In a deflection yoke including a coil separator with a neck portion and a screen portion, and horizontal and vertical deflection coils provided on the inner and outer portions of said coil separator, said deflection yoke mounted with a leakage magnetic-field canceling coil comprising:

a bottom side formed in parallel with said screen portion of said coil separator;

left and right sides extending straightly from both ends of said bottom side to an apex peak point to be set in the range of $\frac{1}{4}$ of the length of said bottom side from the both ends of said bottom side;

a first diagonal side straightly connecting one end of said left side and the right end of said bottom side; and a second diagonal side straightly connecting one end of said right side and the left end of said bottom side.

2. A deflection yoke as claimed in claim 1, wherein said leakage magnetic-field canceling coil is mounted on the same axial where said vertical deflection coils are provided.

3. A deflection yoke as claimed in claim 1, wherein said leakage magnetic-field canceling coil is shaped to be similar to a right triangle having long diagonal sides.

4. A deflection yoke as claimed in claim 1, wherein said leakage magnetic-field canceling coil shaped as said triangles is formed allow input and output terminals of current applied from said horizontal deflection coil to near said bottom side, thereby decreasing the number of turns of said other two sides.

5. In a deflection yoke including a coil separator with a neck portion and a screen portion, and horizontal and vertical deflection coils provided on the inner and outer portions of said coil separator, said deflection yoke mounted with a leakage magnetic-field canceling coil comprising:

a bottom side formed in parallel with the surface of said screen portion of said coil separator contacting said horizontal deflection coil;

left or right side extending straightly from alternative one end of said bottom side to an apex peak point to be set in the range of $\frac{1}{4}$ of the length of said bottom side from the alternative one end of said bottom side; and a diagonal side straightly connecting said side with said bottom side.

6. A deflection yoke as claimed in claim 1, wherein said leakage magnetic-field canceling coil shaped as said triangles is formed allow input and output terminals of current applied from said horizontal deflection coil to near said bottom side, thereby decreasing the number of turns of said other two sides.

* * * * *